US005498200A

United States Patent [19]

Werner

[11] Patent Number: 5,498,200

[45] Date of Patent: Mar. 12, 1996

[54] DEVICE FOR PARALLEX-FREE CENTERING OF A BLANK FOR A GLASS LENS FOR SPECTACLES AND FOR PROVIDING MARKINGS AND/OR ATTACHING A HOLDER BEFORE INSERTING THE BLANK INTO A GRINDING MACHINE FOR BLANKS FOR GLASS LENSES

[75] Inventor: Ralf Werner, Hilden, Germany

[73] Assignee: Wernicke & Co. GmbH, Düsseldorf, Germany

[21] Appl. No.: 289,388

[22] Filed: Aug. 12, 1994

[51] Int. Cl.[6] ..... B24B 13/005

[52] U.S. Cl. ..... 451/460; 451/390; 451/42

[58] Field of Search ..... 451/6, 42, 384, 451/390, 460, 412, 255

[56] References Cited

U.S. PATENT DOCUMENTS

| | | | |
|---|---|---|---|
| 1,984,121 | 12/1934 | Drescher | 451/384 |
| 4,543,752 | 10/1985 | Kötting | 451/384 |
| 4,737,918 | 4/1988 | Langlois et al. | 451/6 |
| 4,936,056 | 6/1990 | Gaudel et al. | 451/390 |
| 5,070,657 | 12/1991 | Brule et al. | 451/460 |
| 5,209,026 | 5/1995 | Cariou et al. | 451/460 |
| 5,425,665 | 6/1995 | Kennedy | 451/460 |

FOREIGN PATENT DOCUMENTS

| | | | |
|---|---|---|---|
| 2270988 | 12/1975 | France | 451/390 |
| 3161259 | 7/1991 | Japan | 451/42 |
| 3161260 | 7/1991 | Japan | 451/42 |

*Primary Examiner*—Bruce M. Kisliuk
*Assistant Examiner*—George Nguyen
*Attorney, Agent, or Firm*—Robert W. Becker & Associates

[57] ABSTRACT

A device for parallax-free centering of an eyeglass lens blank and for application of markings and optionally a holder before insertion of the eyeglass lens blank into an eyeglass edge grinding machine has a stage for the eyeglass lens blank. An electric drive is connected to the stage which is moveable in an upward and downward direction by the electric drive. A depressor for holding the eyeglass lens blank on the stage is provided. The depressor allows for lateral movement of the eyeglass lens blank in a support plane of the stage. The depressor is moveable in the upward and downward direction. A first proximity detector is operatively connected with the electric drive and with the depressor for positioning at a predetermined height the eyeglass lens blank held between depressor and stage. A light divider is positioned between the eyeglass lens blank and the eye of an operator of the device for superimposing a scale; and a template image or an eyeglass frame opening image onto the image of the eyeglass lens blank.

6 Claims, 2 Drawing Sheets

DEVICE FOR PARALLEX-FREE CENTERING OF A BLANK FOR A GLASS LENS FOR SPECTACLES AND FOR PROVIDING MARKINGS AND/OR ATTACHING A HOLDER BEFORE INSERTING THE BLANK INTO A GRINDING MACHINE FOR BLANKS FOR GLASS LENSES

BACKGROUND OF THE INVENTION

The invention relates to a device for parallax-free centering of an eyeglass lens blank and for applying markings and/or a block holder prior to mounting the eyeglass lens blank in an eyeglass lens edge grinding machine, in which a light divider located between the eye and the eyeglass lens blank superimposes upon the image of the eyeglass lens blank an image of a template or of an eyeglass frame opening and of a scale.

In devices of this type, such as the one described for example in DE 40 12 661 A1 by the same applicant, an eyeglass lens blank placed on a translucent stage which is illuminated from below is then viewed through a light divider. Due to the superimposition of an image of a template or of an eyeglass frame opening and of a scale the observer can determine whether the selected diameter for the eyeglass lens blank is suitable for the selected shape of the template and/or the eyeglass frame taking into account the decentration values for the wearer of the eyeglass frame, i.e. is neither too large nor too small. The eyeglass lens blank can be shifted laterally on the stage and adjusted, using the scale, to match the decentration values entered by the optician. Then a block in the form of a sucker or adhesive block is attached at the points on the eyeglass lens blank corresponding to the decentration values or an appropriate marking is applied. The image of the template or the eyeglass frame opening can be imaged by means of a liquid crystal display screen located in the optical path of the light divider. This liquid crystal display screen can also generate a representation of the scale.

To achieve parallax-free representation of the eyeglass lens blank, the superimposed image of a template or of an eyeglass frame opening and of a scale, the liquid crystal display screen and the upper surface of the eyeglass lens blank should be equidistant from the point at which the images are merged in the light divider. When using a liquid crystal display screen located in the viewer's line of sight, this means that the distance of the liquid crystal display screen from a semi-transparent surface of the prism should be equal to the sum of time distances of the eyeglass lens blank from a totally reflective surface of the prism and of this surface from the semi-transparent surface of the prism.

However, to be able to place the eyeglass lens blank on the stage and to be able to join the upper surface of the eyeglass lens blank with the block component it is desirable to design the stage and a depressor which holds the eyeglass lens blank on the stage so as to be upwardly and downwardly movable ensuring thereby, however, that centering is always effected at the prescribed distance from the light divider.

Accordingly, the object of the invention is to improve a device of the type mentioned at time outset in such a way that centering is always carried out at a pre-determinable distance from the light divider in spite of the upward and downward movability of the stage and the depressor.

SUMMARY OF THE INVENTION

Based on this objective, it is proposed by way of invention that in a device of the type mentioned at the outset be provided with an upwardly and downwardly movable, electric-motor-driven stage for the eyeglass lens blank, a depressor which is also upwardly and downwardly movable and holds the eyeglass lens blank on the stage while however allowing for lateral motions in the plane of the stage, and a proximity detector in operative connection with the drive for the stage and with the drive for the depressor and used to position the eyeglass lens blank, held between the depressor and the stage, at a predeterminable height and/or at a predeterminable distance from the light divider.

The device for parallax-free centering of an eyeglass lens blank and for application of markings and optionally a holder before insertion of the eyeglass lens blank into an eyeglass edge grinding machine, the device comprising:

a stage for the eyeglass lens blank;

an electric drive connected to the stage, the stage moveable in an upward and downward direction by the electric drive;

a depressor for holding the eyeglass lens blank on the stage, the depressor allowing lateral movement of the eyeglass lens blank in a support plane of the stage;

the depressor moveable in the upward and downward direction;

a first proximity detector operatively connected with the electric drive and with the depressor for positioning at a predetermined height the eyeglass lens blank held between the depressor and the stage; and a light divider positioned between the eyeglass lens blank and the eye of an operator of the device for superimposing a scale and an image, selected from the group of a template image and an eyeglass frame opening image, onto the image of the eyeglass lens blank.

Preferably, the stage comprises a pan-shaped carrier having spring-loaded slidable bearing pins and the electric drive engages the carrier.

Advantageously, the depressor comprises a hold-down arm and a column guide, the hold-down arm guided on the column guide and having at least three nubs facing the upper side of the eyeglass lens blank. The hold-down arm is preferably guided in the column guide so as to be non-rotatable. The proximity detector is advantageously located in the vicinity of the column guide.

The depressor further comprises a spring for pressing down the hold-down arm so as to bring into contact the spring-loaded slidable bearing pins with the underside of the eyeglass lens blank.

Preferably, the devise further comprises: a pivotable swing arm with a holder comprising a securing member for securing the holder to the swing arm, the holder attachable to the eyeglass lens blank; and a second proximity detector operatively connected with the swing arm and the electric drive for controlling upward movements of the stage together with the centered eyeglass lens blank held by the depressor until the upper side of the eyeglass lens blank makes contact with the holder. The hold-down arm in this embodiment has an opening for allowing passage of the holder through the hold-down arm.

Using the device which is the subject of the invention allows an eyeglass lens blank to be centered in that first the stage is lowered, driven by an electric motor, wherein the depressor follows this movement. Then the depressor is raised and an eyeglass lens blank is laid between the stage and the depressor and held down by the latter once it has been enabled. The drive for the stage is then set in motion, raising the stage with the eyeglass lens blank and the depressor holding it until the proximity detector is triggered at a predeterminable stage height, i.e. at a predeterminable distance to the light divider, and stops the motion. This upwards movement is effected without the eyeglass lens blank jiggling or slipping. The eyeglass lens blank can now be aligned in known fashion through lateral shifting and rotation in regard to its decentration values, the axial position of a cylindrical or prismatic grind and a presbyopia correction segment, if present, using the image of the template or of the eyeglass frame opening and of the scale to do so. Following alignment a marking or block application device will be actuated by means of which the aligned eyeglass lens blank can be marked or filled with a holder block.

The stage may advantageously be formed from a pan-shaped carrier on the upper surface of which are located spring-loaded, slidable bearing pins and which engages with the electric motor drive for the carrier.

The depressor can comprise a hold-down arm movable upward and downward along a column guide with at least three nubs facing the upper surface of the eyeglass lens blank, wherein the hold-down arm can preferably be restrained by the column guide so as to resist rotation and the proximity detector can be located in the vicinity of the column guide.

To hold the eyeglass lens blank between the bearing pins and the nubs on the hold-down arm facing the eyeglass lens blank upper surface, nonetheless ensuring lateral shiftability, a spring may engage with the hold-down arm and shift these and the nubs until they make contact with tile upper surface of the eyeglass lens blank.

The application of a block holder can be integrated into an automated procedure if a slewing pivoted arm is fitted with a securing member for the block to be attached to the eyeglass lens blank, with a proximity detector in operative connection with the slewing arm and the drive for the carrier to control the upward movements of the carrier together with a centered eyeglass lens blank held by the depressor until the upper surface of the eyeglass lens blank makes contact with the block and fitted with an opening in the hold-down arm allowing for the passage of the block. In this case the drive is set in motion by swinging the slewing arm inward; the drive moves the stage with the aligned eyeglass lens blank held by the depressor upward until the block makes contact with and attaches to the upper surface of the eyeglass lens blank. Then the stage with the eyeglass lens blank and the depressor are lowered again so that the eyeglass lens blank with an attached block can be removed from the device.

BRIEF DESCRIPTION OF THE DRAWINGS

The invention is described in detail below on the basis of an embodiment illustrated in the drawing. In the drawing.

DESCRIPTION OF THE PREFERRED EMBODIMENTS

Figure 1:
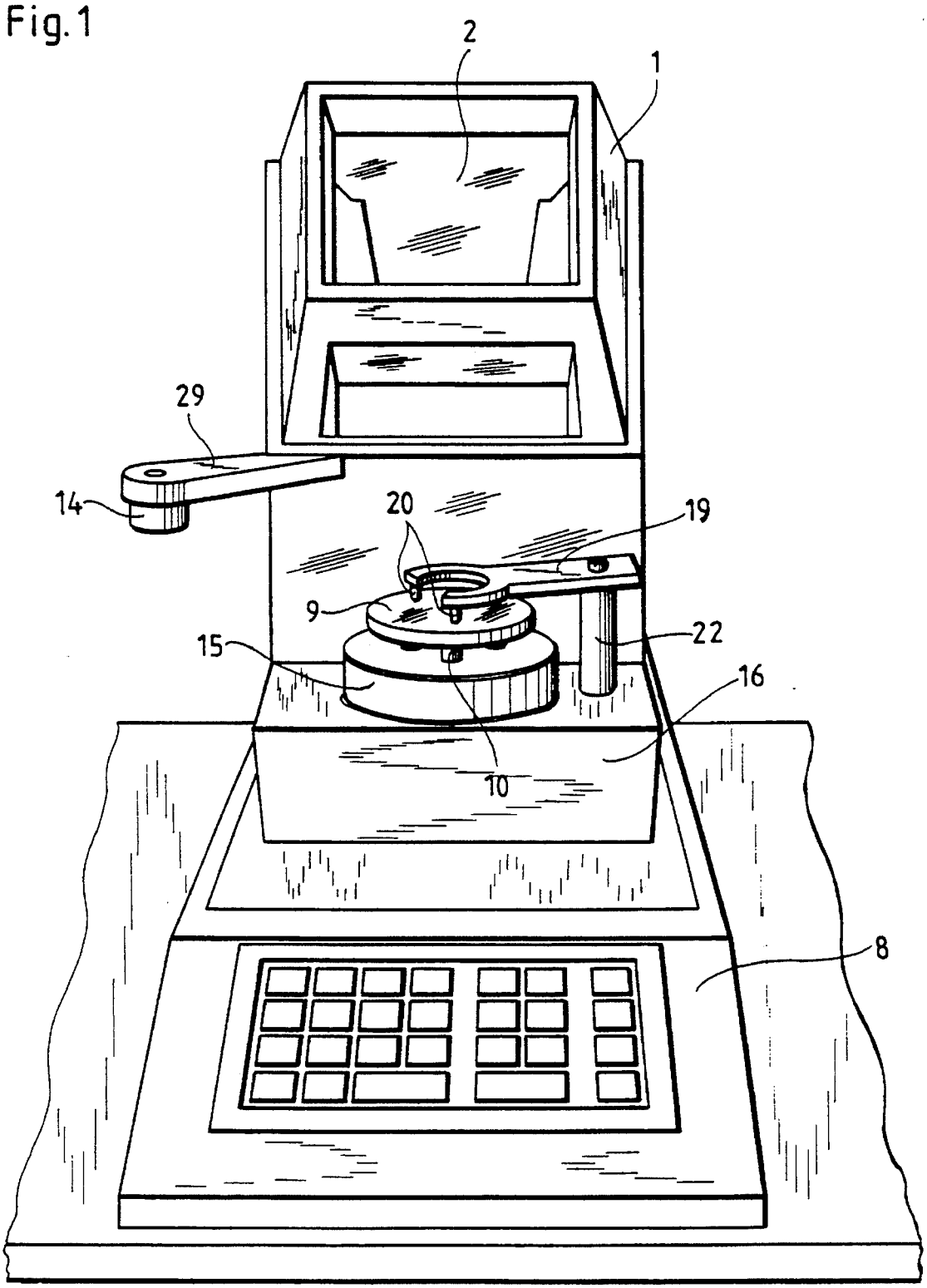
FIG. 1 shows a perspective front view of the device.
Figure 2:
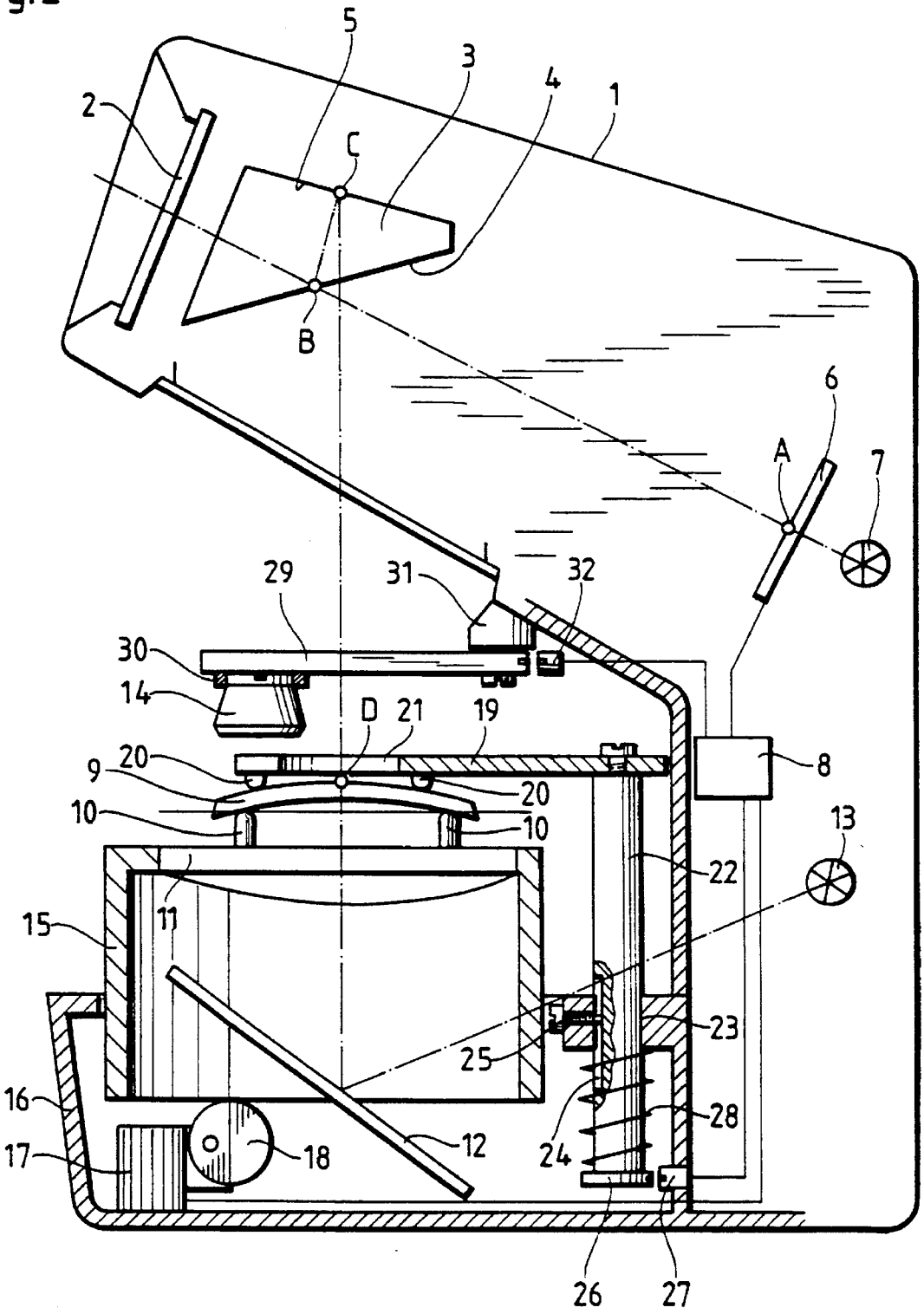
FIG. 2 shows a longitudinal section through the device.

A housing 1 depicted only schematically exhibits a viewing opening with a lens 2, behind which a light divider in the form of a prism 3 is located. The prism 3 exhibits a semi-transparent surface 4 and a totally reflective surface 5.

Located along the axis of the lens 2 at a distance AB from the semi-transparent surface 4 of the prism 3 is a liquid-crystal display (LCD) screen 6. The liquid-crystal display 6 is located in the optical path between a light source 7 and the lens 2. The liquid-crystal display 6 is transparent or translucent so that the representation of the template or of the eyeglass frame opening generated by an electronic control unit 8 and of the scale on the liquid-crystal display 6 is imaged through the prism 3 and in the lens 2.

An eyeglass lens blank 9 is located vertically beneath he prism 3 on spring-loaded, slidable bearing pins 10. Beneath the eyeglass lens blank 9 is a ground glass disk 11 which is illuminated by a light source 13 reflecting off a mirror 12. In this way an image of the eyeglass lens blank 9 is imaged via the totally reflective surface 5 and the semi-transparent surface 4 of the prism 3 in the lens 2. If the distance CD between the totally reflective surface 5 of the prism 3 and the eyeglass lens blank 9 plus the distance BC from the semi-transparent surface 4 to the totally reflective surface 5 of the prism 3 is equal to the distance AB of the liquid-crystal display 6 from the semi-transparent surface 4, then the images of the eyeglass lens blank 9 and the representation of the template or of the eyeglass frame opening and of the scale on the liquid-crystal display 6 will appear without parallax in the same plane in the lens 2 so that the eyeglass lens blank 9 can without difficulty be aligned in reference to the representation of the template or of the eyeglass frame opening and of the scale.

The slidable bearing pins 10 and the ground glass disk 11 are located in a pan-shaped carrier 15 which is mounted in a lower housing section 16 so as to be movable upwardly and downwardly. A drive in the form of a geared electric motor 17 to which is attached an eccentric 18 is mounted beneath the carrier 15 in such a way that the eccentric 18 is in contact with the lower surface of the carrier 15. The carrier 15 can be moved upward and downward as desired by actuating the electric motor 17 and the corresponding rotary movement of the eccentric 18. Located above the carrier 15 is a hold-down arm 19 attached to a guide column 22 which in turn is itself guided in a hole 23 in the lower housing section 16. An opening 21 in the hold-down arm 19 is located approximately concentric to the axis of the eyeglass lens blank 9 laid on the bearing pins 10. This eyeglass lens blank 9 is pressed against the spring-loaded, slidable bearing pins 10 by at least three nubs 20 which are spaced uniformly around the opening 21. The hold-down arm 19 is guided in the hole 23 in such a way that the nubs 20 for the upper surface of the eyeglass lens blank define a plane which is perpendicular to the line CD to the prism 3. The guide column 22 exhibits an axial groove 24 into which a threaded pin 25 protrudes so that the guide column 22 is held within the hole 23 in such a way that it can be moved up and down but cannot be rotated. A spring 28 which acts on a flange 26 at the end of the guide column 22 constantly pulls the hold-down arm 19 against the upper surface of the eyeglass lens blank and is dimensioned so that the bearing pins 10 will yield under spring action to the extent that even with the variations in thickness imparted by a cylindrical or prismatic grind exact contact between the upper surface of the eyeglass lens blank and the nubs 20 and between the lower surface of the eyeglass lens blank and the bearing pins 10 is assured. A proximity detector 27 is located near the flange 26 at the lower housing section 16. Both the proximity detector 27 and the electric motor 17 are connected to the electronic control unit 8.

In addition, located above the hold-down arm 19 is a swinging arm 29 which can rotate around a vertical axis at a bearing 31 on the housing 1, in a plane parallel to the hold-down arm 19. Located at the swinging arm 29 is a securing member 30 for a holder 14, e.g. a sucker or an adhesive block. Located within the reach of the swinging arm 29 is a further proximity detector 32 which is also connected electrically to the electronic control unit 8.

To align and center the eyeglass lens blank 9 the carrier 15 is first lowered by the appropriate actuation of the electric motor 17. The hold-down arm 19 is raised either manually or by means of an electric motor in a fashion not depicted so that a clear space is created between the bearing pins 10 at the carrier 15 and the nubs 20 on the hold-down arm 19, between which an eyeglass lens blank 9 which is to be aligned and centered can be laid. Then the hold-down arm 19 is lowered until the nubs 20 make contact with the eyeglass lens blank upper surface, whereby exact alignment of the eyeglass lens blank upper surface is effected in a plane perpendicular to line CD, wherein support is provided in at least three points by the spring-loaded, slidable bearing pins 10 which, as previously mentioned, adapt to suit the varying edge thicknesses of the eyeglass lens blank 9.

The carrier 15 together with the eyeglass lens blank 9 and the hold-down arm 19 which hold it are then raised by means of the electric motor 17 and the eccentric 18 until the prescribed distance CD to the totally reflective surface 5 of the prism 3 has been reached. At this distance the proximity detector 27 generates a signal which passes to the electronic control unit 8 and stops the electric motor 17.

The eyeglass lens blank 9 is now viewed through the lens 2, wherein the image of a template or of an eyeglass frame opening and of a scale shown on the liquid-crystal display 6 is superimposed on the image of the eyeglass lens blank 9. Operating on the basis of these superimposed images the eyeglass lens blank 9 is aligned in regard to its decentration values, the axial position of a cylindrical or prismatic grind and a presbyopia correction segment, if present.

Once the eyeglass lens blank 9 has been aligned and centered the holder 14, in the form of a sucker or adhesive block and mounted in the securing member 30 on the swinging arm 29, is moved along axis CD in response to which the electric motor 17 with the eccentric 18 is again put in motion via the electronic control unit 8, moving the carrier 15 with the eyeglass lens blank 9 and the hold-down arm 19 upward until the holder 14 passing through the opening 21 makes contact with the upper surface of the eyeglass lens blank 9 and attaches to the same. If the carrier 15 with the eyeglass lens blank 9 and the hold-down arm 19 is now lowered, this being effected automatically by, the electronic control unit 8, the holder 14 detaches from the securing member 30 so that the eyeglass lens blank 9 with the holder 14 attached thereto can be removed from the device after termination of the downward motion and lifting of the hold-down arm 19. Then the eyeglass lens blank 9 can be mounted by means of the holder 14 in the correct position and angle in known fashion in an eyeglass edge grinding machine where the further machining of the eyeglass lens blank 9, i.e. grinding the peripheral contour in accordance with the prescribed eyeglass frame shape and the grinding of a bevel, is performed.

The data for a plurality of templates and/or eyeglass frame openings can be stored in the electronic control unit 8, which are imaged at the liquid-crystal display 6 when an appropriate address is specified. This eliminates the need to keep a large number of templates on hand and to mount them in the device; rather it is sufficient to enter the desired eyeglass frame shape in order to be able to undertake alignment and centering of the eyeglass lens blank. This alignment and centering is effected with great accuracy and free of parallax since the imaging plane of the eyeglass lens blank 9 is always at the prescribed distance CD from the totally reflective surface 5 of the prism 3, which is guaranteed by the arrangement of the proximity detector 27.

The present invention is, of course, in no way restricted to the specific disclosure of the specification and drawings, but also encompasses any modifications within the scope of the appended claims.

I claim:

1. A device for parallax-free centering of an eyeglass lens blank and for application of markings and for aligning a holder on a lens blank before insertion of the eyeglass lens blank into an eyeglass edge grinding machine, said device comprising:

a stage for the eyeglass lens blank;

an electric drive connected to said stage, said stage moveable in an upward and downward direction by said electric drive;

a depressor for holding the eyeglass lens blank on said stage, said depressor allowing lateral movement of the eyeglass lens blank in a support plane of said stage;

said depressor moveable in the upward and downward direction;

a first proximity detector operatively connected with said electric drive and with said depressor for positioning at a predetermined height the eyeglass lens blank held between said depressor and said stage; and a light divider positioned between the eyeglass lens blank and the eye of an operator of said device for superimposing a scale and an image, selected from the group of a template image and an eyeglass frame opening image, onto the image of the eyeglass lens blank.

2. A device according to claim 1, wherein said stage comprises a pan-shaped carrier having spring-loaded slidable bearing pins and wherein said electric drive engages said carrier.

3. A device according to claim 1, wherein said depressor comprises a hold-down arm and a column guide, said hold-down arm guided on said column guide and having at least three nubs facing the upper side of the eyeglass lens blank.

4. A device according to claim 3, wherein said hold-down arm is guided in said column guide so as to be non-rotatable and wherein said proximity detector is located in the vicinity of said column guide.

5. A device according to claim 3, wherein said depressor further comprises a spring for pressing down said hold-down arm so as to bring into contact said spring-loaded slidable bearing pins with the underside of the eyeglass lens blank.

6. A device according to claim 3, further comprising:

a pivotable swing arm with a holder comprising a securing member for securing said holder to said swing arm, said holder attachable to the eyeglass lens blank;

a second proximity detector operatively connected with said swing arm and said electric drive for controlling upward movements of said stage together with the centered eyeglass lens blank held by said depressor until the upper side of the eyeglass lens blank makes contact with said holder; and wherein said hold-down arm has an opening for allowing passage of said holder through said hold-down arm.

* * * * *